US011499743B1

(12) United States Patent
Jacobson

(10) Patent No.: US 11,499,743 B1
(45) Date of Patent: Nov. 15, 2022

(54) GRILLE ASSEMBLY

(71) Applicant: James Jacobson, Bradenton, FL (US)

(72) Inventor: James Jacobson, Bradenton, FL (US)

( * ) Notice: Subject to any disclaimer, the term of this patent is extended or adjusted under 35 U.S.C. 154(b) by 0 days.

(21) Appl. No.: 17/691,737

(22) Filed: Mar. 10, 2022

(51) Int. Cl.
*F24F 13/08* (2006.01)

(52) U.S. Cl.
CPC ..... *F24F 13/084* (2013.01)

(58) Field of Classification Search
CPC ..... F24F 13/084; F24F 13/082
USPC ..... 454/280, 271
See application file for complete search history.

(56) References Cited

U.S. PATENT DOCUMENTS 6,165,066 A * 12/2000 Sharp ..... F24F 13/082 52/302.1
2005/0279065 A1* 12/2005 Simmons ..... B01D 46/10 55/495

* cited by examiner

*Primary Examiner* — Vivek K Shirsat
(74) *Attorney, Agent, or Firm* — Plager Schack LLP; Mark H. Plager; Naomi Mann

(57) ABSTRACT

Disclosed is a grille assembly, which may comprise a grille plate including airflow cutouts within the grille plate, and may be designed to integrate with, or enhance the décor of a room. In certain embodiments, the grille assembly may further comprise an airflow regulator including a main body configured to insert into an airduct opening within a building structure, and the grille plate is configured to mount to a surface of the building structure over the airduct opening and airflow regulator inserted therein.

5 Claims, 4 Drawing Sheets

GRILLE ASSEMBLY

BACKGROUND

The present disclosure relates generally to air duct/ventilation systems including air duct grilles.

A grille may be used to cover an air duct of a heating, cooling, and/or ventilation system, and may typically be installed or mounted to a wall or ceiling over an air duct opening. Conventional grilles may be made of metal, which may rust, collect dust, and/or be unsightly. As such, an improved air duct grille system is desirable.

SUMMARY

According to various embodiments, disclosed is a grille assembly, which may comprise a grille plate including airflow cutouts within the grille plate. In embodiments, the grille plate may be designed to integrate with, or enhance the décor of a room. In certain embodiments, the grille assembly may further comprise an airflow regulator including a main body configured to insert into an airduct opening within a building structure, wherein the grille plate is configured to mount to a surface of the building structure over the airduct opening and airflow regulator inserted therein.

In some embodiments, the grille assembly may further comprise an inner mounting plate coupled to the airflow regulator, wherein the grille plate is configured to attach to the inner mounting plate opposite the main body of the airflow regulator. In certain embodiments, a clearance space may be provided between the grille plate and the inner mounting plate.

In some embodiments, the grille assembly may further comprise fastening and/or spacer components configured to attach the grille plate to the inner mounting plate and to provide the clearance space therebetween. In certain embodiments, the grille plate may include grille plate holes configured to align with mounting holes within the inner mounting plate, wherein the fastening and/or spacer components may be engaged through the grille plate holes and the mounting holes to attach the grille plate to the inner mounting plate. In some further embodiments, the fastening and/or spacer components may include female rivet fasteners, shoulder washer spacers, and bolts, wherein the female rivet fasteners may be engaged through the mounting holes within the inner mounting plate, the shoulder washer spacers may be placed over the rivet fasteners, and the bolts may be driven through the grille plate holes, shoulder washer spacers, and female rivet fasteners to attach the grille plate to the inner mounting plate.

In certain embodiments, the inner mounting plate is configured to couple to the surface of the building structure over the airduct opening via fasteners inserted through mounting holes within the inner mounting plate. In some embodiments, the inner mounting plate may include a regulator opening configured to receive a front end of the airflow regulator, wherein the front end of the airflow regulator is configured to attach to the inner mounting plate proximate the regulator opening. In some embodiments, the regulator may be a constant volume regulator. In some further embodiments, the grille plate may be made of a rigid material comprising acrylic and/or Dibond.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
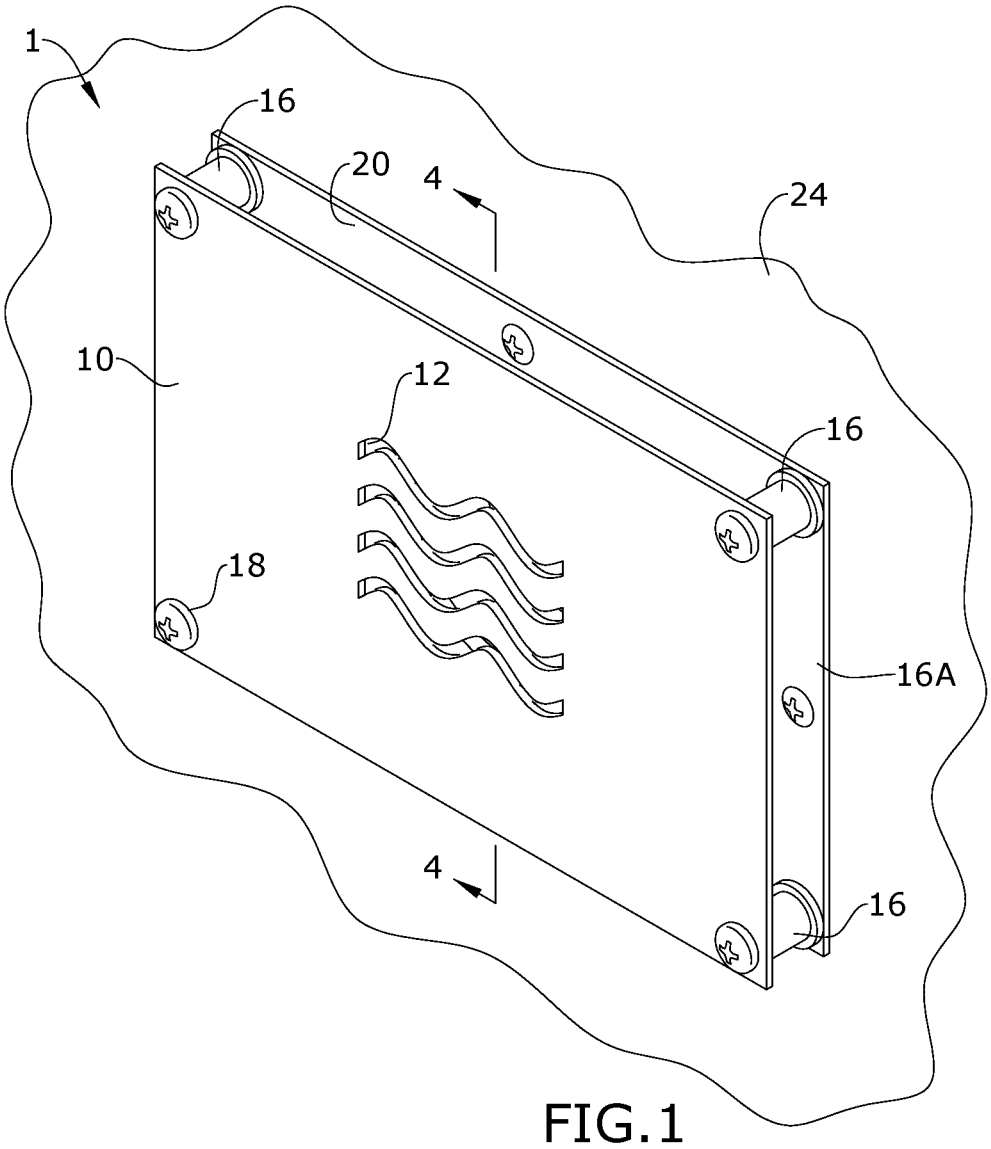
FIG. 1 is a perspective view of a grille assembly, in accordance with various embodiments.
Figure 2:
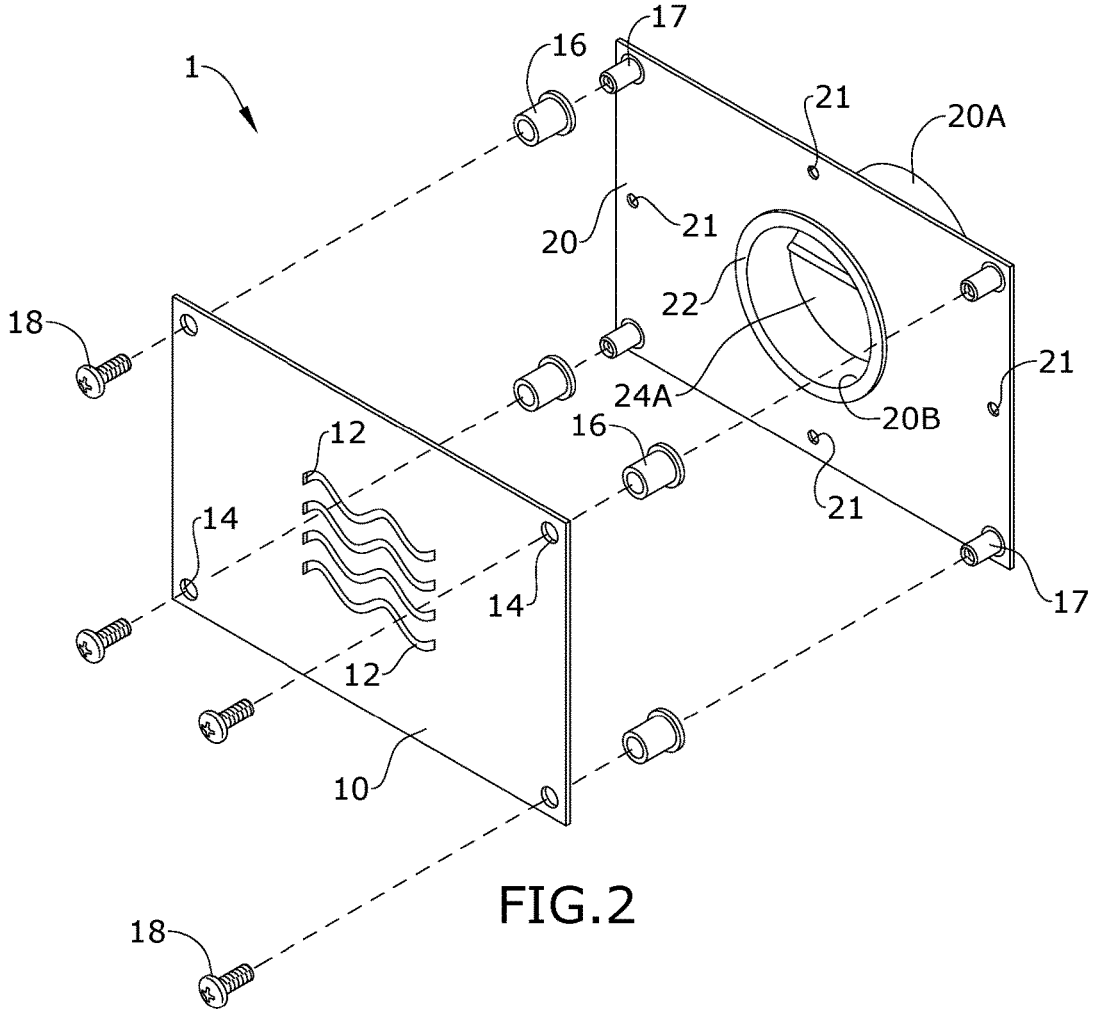
FIG. 2 is an exploded view thereof.
Figure 3:
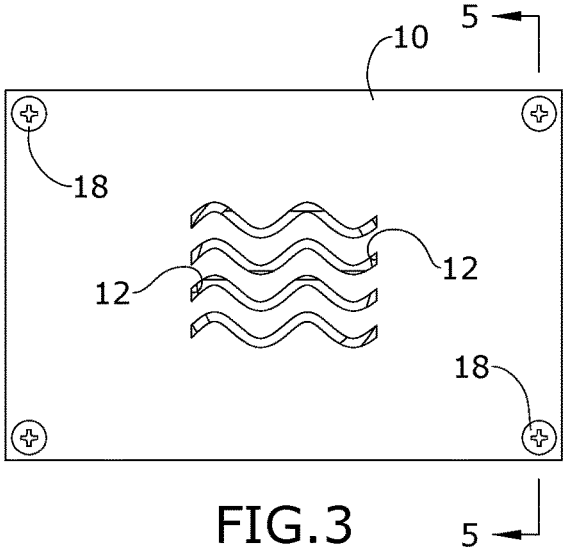
FIG. 3 is a front view thereof.
Figure 4:
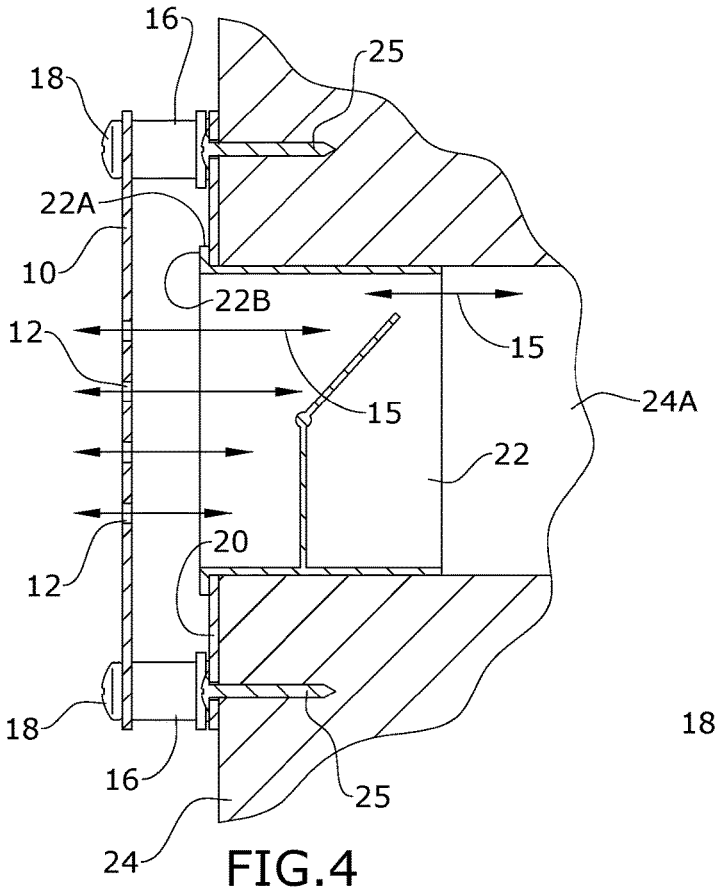
FIG. 4 is a section view taken along line 4-4 in FIG. 1.
Figure 5:
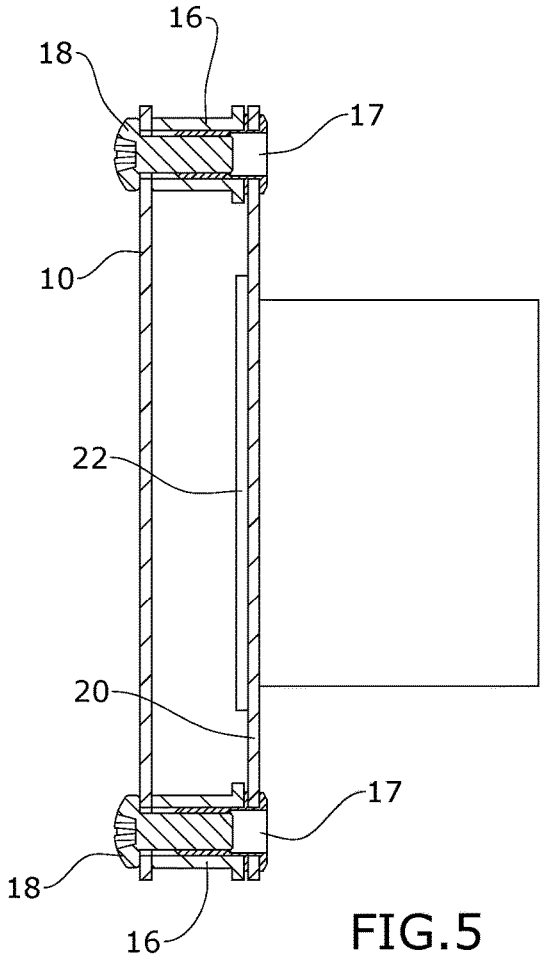
FIG. 5 is a section view taken along line 5-5 in FIG. 3.
Figure 6:
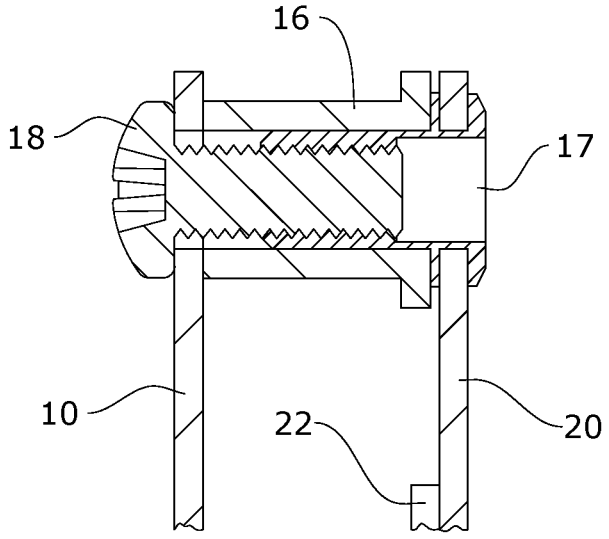
FIG. 6 is a detailed section view taken along line 5-5 in FIG. 3.

According to various embodiments as depicted in FIGS. 1-6, disclosed is a grille assembly 1 comprising a grille plate 10, which may be mounted to a surface 24 of a building structure such as a wall, ceiling, or floor, over an air duct opening 24A. Building structure may be for example, a room in a home or other private residence, hotel, restaurant, and the like. In embodiments, grille assembly 1 may further comprise an airflow regulator 22, which may be a constant airflow regulator. In further embodiments, grille assembly 1 may comprise an inner mounting plate 20, wherein airflow regulator 22 may be installed within airduct opening 24A, inner mounting plate 20 may be coupled to airflow regulator 22, and grille plate 10 may be coupled to inner mounting plate 20 opposite airflow regulator main body 20A.

In embodiment grille plate 10 may comprise air flow cutout(s) 12. In some embodiments, grille plate 10 is coupled to mounting plate 20, with a clearance space 16A provided between the two plates. According to various embodiments, clearance space 16A may be between approximately 0.25 inches and approximately 1.5 inches. Thus, airflow 15 in or out of airduct opening 24A and regulator 22 may pass through cutout(s) 12 and clearance space 16A.

In certain embodiments, air flow cutout(s) 12 may have a decorative design. In one embodiment as shown in the figures, airflow cutout(s) 12 may comprise a plurality of waves. It shall be appreciated that a variety of different cutout designs may be used in different embodiments. In certain embodiments, grille plate 12 may be made of a rigid material such as acrylic and/or Dibond but is not limited to these options. Additionally, grille plate 12 and mounting plate 20 may have various geometric shapes, including rectangular (as shown), square, circular, oval, etc., and may have different dimensions and colors according to various embodiments. In certain embodiments, grille plate 10 may be custom designed to integrate with or enhance the décor of a room.

In certain embodiments, grille plate 10 may be mounted to mounting plate 20 via various fastening and/or spacer components. In one embodiment, mounting plate 20 may be provided with mounting holes 21, and grille plate 10 may be provide with grille plate holes 14 configured to align with at least a portion of mounting holes 21. Female rivet nut fastener 17, may be inserted through the mounting holes 21 that align with the grille plate holes, and shoulder washer spacers 16 (e.g., Nylon shoulder washers) may be fitted over the rivet nut fasteners 17. In one embodiment, rivet nut fasteners 17 may be press fitted into mounting holes 21. Grille plate 10 may then be coupled to mounting plate 20 via male fasteners 18 (i.e., bolts) driven through grille plate holes 14, spacers 16, and fasteners 17.

In some embodiments, mounting plate 20 may be mounted to surface 24 (building surface 24) over airduct opening 24A via wall fasteners 25 such as nails or screws, which may be driven through at least a portion of mounting holes 21, to secure mounting plate 20 to building surface 24. In certain embodiments, male fasteners 18 may also extend into building surface 24. In one embodiment as depicted in the figures, grille plate 12 and mounting plate 20 have corresponding rectangular shapes, wherein corresponding holes 14 and 21 are provided proximate each corner of the plates for attachment of the grille plate to the mounting plate; and additional holes 21 are provided around the sides of the mounting plate for attachment of the mounting plate to the building surface via fasteners 25.

In embodiments, airflow regulator 22 is configured to insert into airduct opening 24A and includes a front end 22A configured to attach to mounting plate 20 at a regulator opening 20B within mounting plate 20. Mechanisms for attachment/bonding of the regulator to the mounting plate/airduct opening may include, for example, glue, spin-in connection, duct fitting connection, and the like, depending on the type of regulator. In certain embodiments, front end 22A of airflow regulator 22 may include an outer lip 22B which may be attached to a front side of mounting plate 20 around opening 20B, such that a portion of mounting plate 20 proximate opening 20B may be captured between outer lip 22B and surface 24, when grille assembly 1 is installed. In some embodiments, airflow regulator 22 may be a constant volume regulator for balancing airflow. In certain embodiments, airflow regulator 22 may be sized and shaped to snuggly fit within airduct opening 24A. As such, regulator 22 may be embedded within airduct opening 24A, and mounting plate 20 may be attached to building surface 24 over regulator 22 and airduct opening 24A via fasteners 25 and/or fasteners 18.

In one embodiment, grille assembly 1 may be installed by press fitting rivet nut fasteners 17 into corner mounting holes 21 within mounting plate 20. Nylon shoulder washers 16 may then be placed over rivet nut fasteners 17 for proper spacing of grille plate 10 from mounting plate 20. Regulator 22 may be attached to mounting plate 20 through regulator opening 20B within mounting plate 20, and the regulator and mounting plate may be placed over an airduct opening, wherein airflow regulator main body 20A is inserted into the airduct. In embodiments, the regulator may be glued or screwed in place. Additionally, nails or screws may be driven through side mounting holes 21 within plate 20 to attach plate 20 to the building surface around the airduct. Holes 14 within grille plate 10 may then be aligned against the shoulder washers 16 within plate 20, and screws may be driven through holes 14 and shoulder washers 16/rivet nut fasteners 17 to attach grille 10 to mounting plate 20.

It shall be appreciated that the disclosed grille assembly 1 can have multiple configurations in different embodiments. In some embodiments, the disclosed assembly may be sized and shaped to fit a standard HVAC system. In some embodiments, the disclosed assembly may be customized for a unique look and/or to fit a specific HVAC system. It shall be appreciated that the components of grille assembly 1 described in several embodiments herein may comprise any alternative known materials in the field and be of any shape, size and/or dimensions. It shall be appreciated that the components of grille assembly 1 described herein may be manufactured and assembled using any known techniques in the field. In one embodiment, grille plate 10 and mounting plate 20 may be designed using a computer aided drawing program and laser machine/Colex/Router Machine process.

The disclosed subject matter provides a grille assembly which may be customized to provide the user with design options, and may aesthetically enhance any room while balancing and controlling airflow in or out of the room.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A grille assembly, comprising:

a grille plate including airflow cutouts within the grille plate;

an airflow regulator including a main body configured to insert into an airduct opening within a building structure, wherein the grille plate is configured to mount to a surface of the building structure over the airduct opening and the airflow regulator inserted therein;

an inner mounting plate configured to couple to the airflow regulator, wherein the grille plate is configured to attach to the inner mounting plate opposite the main body of the airflow regulator, and wherein a clearance space is provided between the grille plate and the inner mounting plate when the grille plate is attached to the inner mounting plate; and fastening and/or spacer components configured to attach said grille plate to said inner mounting plate and to provide said clearance space therebetween, said grille plate including grille plate holes configured to align with mounting holes within said inner mounting plate, wherein said fastening and/or spacer components are configured to engage through said grille plate holes and said mounting holes to attach said grille plate to said inner mounting plate, said fastening and/or spacer components including female rivet fasteners, shoulder washer spacers, and bolts, wherein said female rivet fasteners are configured to engage through said mounting holes within said inner mounting plate, said shoulder washer spacers are configured to position over said rivet fasteners, and said bolts are configured to insert through said grille plate holes, said shoulder washer spacers, and said female rivet fasteners to attach said grille plate to said inner mounting plate.

2. The grille assembly of claim 1, wherein said inner mounting plate is configured to couple to said surface of said building structure over said airduct opening via fasteners inserted through mounting holes within said inner mounting plate.

3. The grille assembly of claim 2, wherein said inner mounting plate includes a regulator opening configured to receive a front end of said airflow regulator, and wherein said front end of said airflow regulator is configured to attach to said inner mounting plate proximate said regulator opening.

4. The grille assembly of claim 1, wherein said regulator is a constant volume regulator.

5. The grille assembly of claim 1, wherein the grille plate is made of a rigid material comprising acrylic and/or Dibond.

* * * * *